73-658 SR
XR 3,936,822 R/

United States I 3,936,822
Hirschberg Feb. 3, 1976

[54] METHOD AND APPARATUS FOR DETECTING WEAPON FIRE

[76] Inventor: Kenneth A. Hirschberg, 13866 Espada Court, Saratoga, Calif. 95070

[22] Filed: June 14, 1974

[21] Appl. No.: 479,225

[52] U.S. Cl. ..... 340/420; 73/552; 250/338; 250/340; 340/227 R; 340/421
[51] Int. Cl.[2] ..... G08B 17/12
[58] Field of Search ..... 73/558, 557, 555, 552, 73/70, 69, 167, 170 R; 250/338, 340; 340/1 R, 227 R, 261, 420, 421; 179/1 N

[56] References Cited

UNITED STATES PATENTS

| | | | |
|---|---|---|---|
| 2,962,696 | 11/1960 | Snyder | 73/69 X |
| 3,147,380 | 9/1964 | Buckingham et al. | 250/338 |
| 3,254,219 | 5/1966 | Finlay et al. | 250/338 |
| 3,281,811 | 10/1966 | Cotterman et al. | 340/227 R |
| 3,665,440 | 5/1972 | McMenamin | 250/338 |
| 3,825,754 | 7/1974 | Cinzori et al. | 250/338 |

FOREIGN PATENTS OR APPLICATIONS

| | | | |
|---|---|---|---|
| 709,052 | 5/1965 | Canada | 340/227 |

*Primary Examiner*—Richard C. Queisser
*Assistant Examiner*—Stephen A. Kreitman
*Attorney, Agent, or Firm*—Victor R. Beckman

[57] ABSTRACT

A round detecting method and apparatus are disclosed for automatically detecting the firing of weapons, such as small arms, or the like. Radiant and acoustic energy produced upon occurrence of the firing of the weapon and emanating from the muzzle thereof are detected at known, substantially fixed, distances therefrom. Directionally sensitive radiant and acoustic energy transducer means directed toward the muzzle to receive the radiation and acoustic pressure waves therefrom may be located adjacent each other for convenience. In any case, the distances from the transducers to the muzzle, and the different propagation velocities of the radiant and acoustic waves are known. The detected radiant (e.g. infrared) and acoustic signals are used to generate pulses, with the infrared initiated pulse being delayed and/or extended so as to at least partially coincide with the acoustic initiated pulse; the extension or delay time being made substantially equal to the difference in transit times of the radiant and acoustic signals in traveling between the weapon muzzle and the transducers. The simultaneous occurrence of the generated pulses is detected to provide an indication of the firing of the weapon. With this arrangement extraneously occurring radiant and acoustic signals detected by the transducers will not function to produce an output from the apparatus unless the sequence is correct and the timing thereof fortuitously matches the above-mentioned difference in signal transit times. If desired, the round detection information may be combined with target miss-distance information for further processing and/or recording.

13 Claims, 4 Drawing Figures

3936822
OR IN 340/420

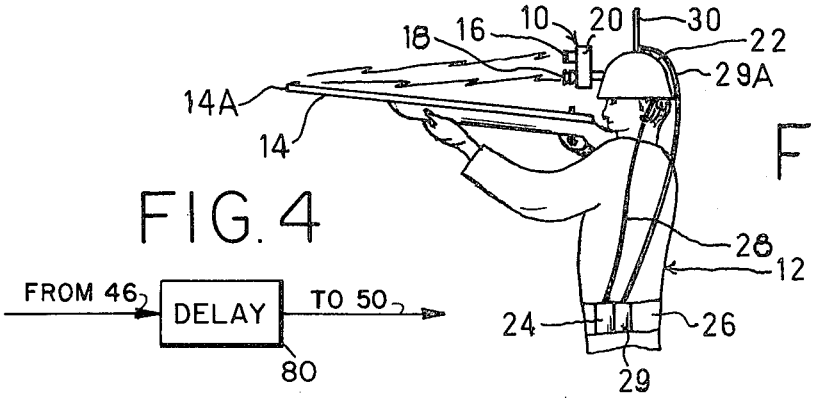
FIG-1
FIG. 4
FIG-2
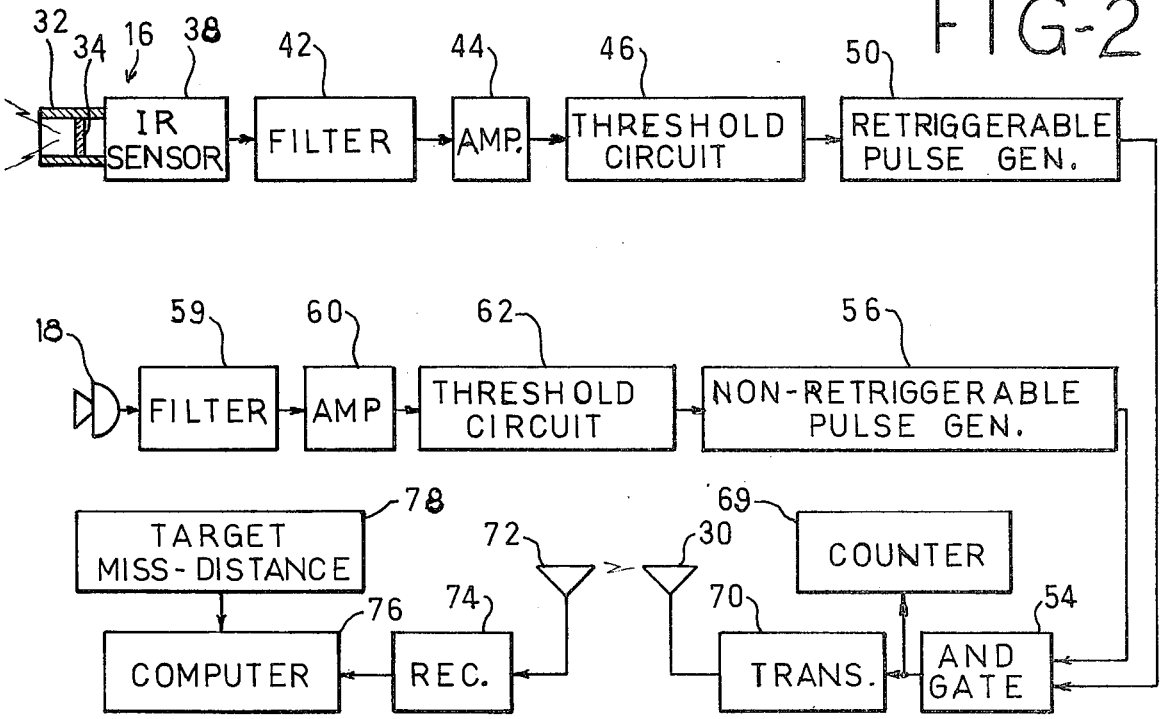
FIG-3
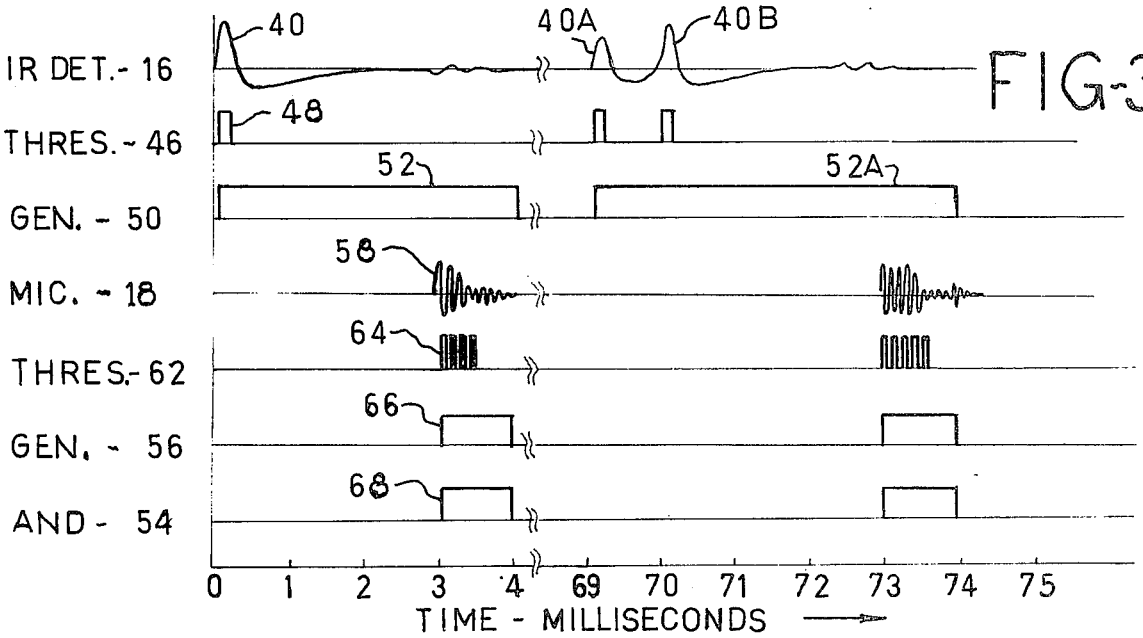

METHOD AND APPARATUS FOR DETECTING WEAPON FIRE

BACKGROUND OF THE INVENTION

The detecting method and means of this invention is particularly well adapted for the detection of small arm firing for training purposes on a firing range. Prior art round detectors which are responsive to a single signal such as sound produced by the weapon fire, are well known. However, in the presence of other weapon fire many such prior art detectors respond to the firing of all of them without discrimination rendering the same useless under such conditions.

SUMMARY OF THE INVENTION AND OBJECTS

An object of this invention is the provision of a detector for detecting small arms, fire, or the like, that avoids the above and other shortcomings and faults of the prior art arrangements.

An object of this invention is the provision of method and apparatus for round detecting that is substantially non-responsive to extraneous sounds or radiant energy in the vicinity thereof, including the firing of other weapons.

The above and other objects and advantages are achieved by use of radiant and acoustic energy transducers located a known distance from the muzzle of the weapon, the firing of which weapon is to be detected. Radiation and acoustic energy signals produced upon firing the weapon are detected by the transducers and fed to separate radiation and acoustic signal channels to initiate the generation of first and second pulses, respectively. The infrared channel pulse is delayed (or the termination thereof is delayed) in an amount substantially equal to the difference in transit times of the radiation and acoustic energy signals in traveling from the weapon to the transducers such that the infrared and acoustic channel pulses (or portions thereof) occur simultaneously. Means, such as an AND gate, for detecting the simultaneous occurrence of the pulses is provided. Radiation and acoustic generated signals detected by the transducers but not having the proper timing for production of simultaneously occurring pulses in the radiation and acoustic channels of the instrument fail to produce an output from the device.

BRIEF DESCRIPTION OF THE DRAWINGS

FIG. 1 is a fragmentary side elevational view of a rifleman equipped with the novel round detector of this invention;

FIG. 2 is a block diagram of one embodiment of the round detector;

FIG. 3 is a diagram of waveforms used to explaim the operation of the round detector, and FIG. 4 is a block diagram of a delay circuit which may be included in the round detector illustrated in FIG. 2.

DESCRIPTION OF EMBODIMENT

Reference first is made to FIG. 1 wherein a round detector 10 is shown carried by a person 12 for detecting the rounds fired from the rifle 14. It will be understood that the round detector is not limited to use with rifles but may be used for detecting rounds fired by other weapons such as pistols, and other ordnance. Also, it is not necessary that the round detector be carried by the person firing the weapon. The round detector is coupled to the weapon only through the atmosphere and may be located at some remote location within operating range of the energy transducers. No wiring to the weapon being fired is required.

The detector 10 includes radiation and acoustic energy transducers 16 and 18, respectively, located a known distance from the muzzle 14A of the rifle. In the illustrated arrangement the transducers are included in a housing 20 attached to the helmet 22 worn by the rifleman 12. Preferably, the receiving patterns of the transducers are directional for improved sensing of radiation and acoustic waves from the muzzle 14A upon firing of the weapon. Operation of the system, however, does not depend upon directivity, and omnidirectional transducers may be used. The radiation detector 16 preferably, but not necessarily, comprises an infrared (IR) transducer responsive to relatively large infrared signals produced at the weapon muzzle upon firing. The acoustic transducer simply may comprise a directional microphone. In use, the rifleman's head is in a relatively fixed position with respect to the rifle while sighting to fire the same. The transducers are directed toward the muzzle to receive the infrared and acoustic energy signals produced thereat which signals propagate through the atmosphere at different rates. Other locations for the radiation and acoustic energy transducers either on the person or removed from the person are contemplated. In the illustrated arrangement wherein the round detector is portable, batteries for operating the same are carried on the belt 26, and are connected thereto through connecting means 28. A transmitter 29 connected through connecting means 29A to a transmitting antenna 30 on the helmet 22 may be included for connection of the round detection information to a remote location.

A block diagram of one embodiment of a circuit for processing the detected radiation and acoustic energy signals from the weapon muzzle is shown in FIG. 2, to which reference now is made. The radiant energy transducer 16 is shown comprising a tube 32 within which is mounted an infrared filter 34, at the input to an infrared sensor 38. The tube extends forwardly of the sensor to limit the viewing angle thereof and the filter blocks radiation in the visible and higher frequency range to minimize transducer response to ambient conditions. Infrared transducers are well known and require no detailed description.

The output signal 40, shown in the waveform diagram of FIG. 3, from the infrared transducer 38 is applied through a band pass filter 42 and amplifier 44 to the input of a threshold circuit 46. When the filtered and amplified signal reaches a predetermined level a signal 48 is produced at the output of the threshold circuit which signal triggers a pulse generator 50. The pulse generator 50 which is retriggerable, may comprise a retriggerable one-shot multivibrator. The pulse output 52 from the retriggerable pulse generator 50 is supplied to an AND gate 54 together with the output from a non-retriggerable pulse generator 56 included in the acoustic channel of the apparatus.

In the acoustic channel the microphone 18 output 58 (FIG. 3) is fed through a band pass filter 59 and amplifier 60 and supplied as an input to a threshold circuit 62. When the acoustic signal output from the amplifier 60 exceeds the threshold level of the circuit an output signal 64 is obtained therefrom which is fed to the non-retriggerable pulse generator 56. As noted above the pulse generator 56 output 66 is supplied as another input to the AND gate 54 and, in the presence of simultaneous input signals thereto from the pulse generators 50 and 56, the AND gate 54 produces an output signal 68 to indicate one round of fire from the rifle 14. The AND gate output may be used to actuate a counting circuit 69 to count the number of rounds fired. In the illustrated arrangement the output 68 also is shown used to gate on a transmitter 70 having an output connected to the antenna 30 included in the communication link to a receiving antenna 72. The received signal is processed by receiver 74 and thence supplied as an input to a computer 76. Other information such as target miss-distance obtained from well known sensing means at the target also may be supplied to the computer.

In use, the radiation signal from the muzzle, traveling at the speed of light, reaches the IR transducer substantially instantaneously with the production thereof. The acoustic signal, on the other hand, traveling much slower at approximately 330 meters/second, requires an appreciable time to reach the microphone. For example, if the acoustic transducer 18 is spaced one meter from the muzzle a transit time of approximately three (3) milliseconds is required for the propagation of the acoustic signal between the muzzle and transducer. In the arrangement shown in FIG. 2 the pulse 52 from the pulse generator 50 in the radiation channel has a duration in excess of the three millisecond transit time so that at least a portion of the pulse 52 coincides with the pulse 66 from the pulse generator 56 in the acoustic channel for actuation of the AND gate 54.

By utilizing a retriggerable pulse generator 50 in the radiation channel, an output from the generator 50 is assured whenever a sufficiently large infrared signal is detected. This is illustrated in the waveform diagram of FIG. 3 wherein an extraneous infrared signal 40A is shown which functions to trigger the generator 50 upon the occurrence thereof. A "valid" infrared signal 40B subsequent thereto is shown which retriggers the generator 50 to provide an extended pulse 52A output therefrom which overlaps, in time, with the generator 56 output 66. It will be apparent that the detection of the round would have been missed if the generator 50 was not retriggerable since the pulse 40B occurred during the presence of a generator 50 output. On the other hand, a non-retriggerable pulse generator 56 in the acoustic channel is employed to prevent undue extension of the pulse 66 with every noise signal received by the microphone.

If desired, a shorter basic radiation channel pulse 52 from the retriggerable generator 50 may be employed by including delay means (e.g. an analog delay line) in the radiation channel to provide for the delayed generation of the pulse 52. In this case a basic radiation channel pulse of substantially the same duration as the acoustic channel pulse 66 may be employed. For example, in the waveform diagram of FIG. 3 the retriggerable pulse generator is 50 shown as having a pulse width of approximately four milliseconds which, of course, is extended if the generator is retriggerable. The further the microphone 18 is located from the muzzle, the longer the basic pulse from generator 50 would have to be to coincide with the pulse 66 from the generator 56. By including a delay circuit in the radiation channel, as mentioned above, a shorter generator pulse 52 may be employed to reduce errors in the round detector output.

The invention having been described in detail in accordance with the requirements of the Patent Statutes, various other changes and modifications will suggest themselves to those skilled in this art. For example, the radiation and acoustic transducers need not be located on the user's helmet but, instead, may be carried at other locations thereon. Also, if desired, the transducers may be located at a point remote from the user and, furthermore, may be located at different distances from the radiation and acoustic source. In addition, a single pair of radiation and acoustic transducers may be used to supply signals to a plurality of radiation and acoustic channels, or portions thereof, for monitoring such signals from a plurality of sources. For example, such a system may be located at the side of a firing line, and various radiation channel delays may be set for the different transit times of the acoustic signals from the selected firing position to the acoustic transducer. Also, the detection of other events than weapon fire is contemplated, so long as the event is produced at a known distance from the transducers and produces signals which travel at different rates from the source of the event to the transducers for sensing the same. It is intended that the above and other such changes and modifications shall fall within the spirit and scope of the invention as defined in the appended claims.

I claim:

1. A method of detecting the occurrence of only an event which occurs at known distances from signal transducers, which event produces first and second signals having different velocities of propagation, such as electromagnetic and acoustic signals, which method comprises, locating at known distances from the event to be detected first and second transducers for detecting said first and second different velocity signals produced as a consequence of said event to be detected, generating in response to detected first and second signals received by said transducers first and second pulses having simultaneously existing portions when the first and second signals are produced as a consequence of said event to be detected, and producing a signal upon simultaneous existence of said first and second pulses to indicate the detection of the occurrence of the event to be detected.

2. The detecting method as defined in claim 1 wherein said first generated pulse has a greater pulse duration than said second generated pulse.

3. The detecting method as defined in claim 2 wherein said first and second generated pulses terminate at substantially the same time when the detected first and second signals are produced as a consequence of said event to be detected.

4. The detecting method as defined in claim 1 including, delaying the generation of said first generated pulse in an amount dependent upon the difference in propagation times of said first and second signals to said transducers for simultaneous occurrence of said first pulse during said second generated pulse when said first and second signals are produced as a consequence of said event to be detected.

5. The detecting method as defined in claim 1 for round detection which includes locating the first and second transducers on a helmet worn by a person firing a weapon having a muzzle from which said electromagnetic and acoustic signals are emitted and at which such transducers are directed for detecting said signals.

6. The detecting method as defined in claim 1 wherein said first and second transducers comprise light and acoustic transducers, respectively, to receive light and acoustic signals produced upon occurrence of said event to be detected:

7. Apparatus for detecting the occurrence of an event which emits first and second signals having different velocities of propagation in the atmosphere said apparatus comprising, first and second transducers located known distances from an event to be detected for detecting said first and second different velocity signals produced as a consequence of said event, means responsive to signals detected by said first and second transducers for generating first and second pulses having simultaneously existing portions when the first and second signals are produced as a consequence of said event, and means under control of said simultaneously occurring pulse portions for producing a signal to indicate the detection of the occurrence of said event.

8. The apparatus as defined in claim 7 wherein said first and second transducers comprise light and acoustic transducers, respectively, responsive to light and acoustic waves emitted upon firing of a weapon.

9. The apparatus as defined in claim 8 wherein said first and second transducers are directed toward the muzzle of the weapon pick up infrared and acoustic energy upon firing the weapon.

10. The apparatus as defined in claim 7 wherein said first pulse generating means generates pulses of greater duration than pulses generated by said second pulse generating means in an amount substantially equal to the difference in transit times of the first and second signals in traveling betwen the event producing the said same and said transducers.

11. The apparatus as defined in claim 7 including delay means for delaying actuation of said first pulse generating means in response to signals detected by said first transducer by an amount substantially equal to the difference in transit times of the first and seocnd signals in traveling between the said event producing the same and said transducers.

12. The apparatus as defined in claim 7 including threshold circuits included in the connection of the transducer outputs to the pulse generatinng means for setting the level of transducer outputs capable of actuating aid pulse generating means.

13. The apparatus as defined in claim 7 wherein said first pulse generating means is retriggerable and said second pulse generating means is non-retriggerable.

* * * * *